US006042319A

United States Patent [19]

Hoffman

[11] Patent Number: 6,042,319

[45] Date of Patent: Mar. 28, 2000

[54] MANUAL CALENDAR BINDER

[75] Inventor: William M. Hoffman, Hamilton, Ohio

[73] Assignee: Stuebing Automatic Machine Co., Cincinnati, Ohio

[21] Appl. No.: 09/299,110

[22] Filed: Apr. 26, 1999

[51] Int. Cl.[7] ..... B42B 5/06

[52] U.S. Cl. ..... 412/34; 412/6

[58] Field of Search ..... 412/1, 6, 33, 34, 412/38, 39, 40, 42, 43; 29/33.5; 72/177; 283/2–4

[56] References Cited

U.S. PATENT DOCUMENTS

| | | | |
|---|---|---|---|
| 1,057,295 | 3/1913 | Stuebing, Sr. . | |
| 1,906,024 | 4/1933 | Todd . | |
| 2,042,912 | 6/1936 | Stuebing, Jr. . | |
| 2,505,241 | 4/1950 | Gray et al. | 72/178 |
| 2,690,781 | 10/1954 | Hall | 29/33.52 |
| 2,749,961 | 6/1956 | Czarnik | 29/33.5 |
| 2,912,038 | 11/1959 | Harper | 72/178 |
| 3,659,330 | 5/1972 | De Villier et al. | 29/564.8 X |
| 3,903,580 | 9/1975 | Lam | 412/34 X |
| 3,946,919 | 3/1976 | Ernst | 226/11 |
| 4,130,933 | 12/1978 | Demrick | 29/33.5 X |
| 4,151,037 | 4/1979 | Klinglhoefer et al. | 156/522 |
| 4,208,750 | 6/1980 | Pfaffle | 412/34 X |
| 4,365,492 | 12/1982 | Kortan et al. | 72/132 X |
| 5,364,215 | 11/1994 | Snellman et al. | 412/4 X |
| 5,496,253 | 3/1996 | Snellman et al. | 281/4.1 |
| 5,707,194 | 1/1998 | Blumberg et al. . | |
| 5,730,571 | 3/1998 | Rinando | 412/34 |

OTHER PUBLICATIONS

Stuebing Machine Co., Cincinnati, Ohio, *The Stuebing Metal Edger*, Circa 1932.

Grammes Inc., Allentown, PA, *Grammes Automatic Metal Edging Machine*, Pre–1998.

John T. Marshall, Ltd., London, England, *Marshall Calendar Rimming Machine*, Pre–1998.

*Primary Examiner*—Willmon Fridie, Jr.

*Attorney, Agent, or Firm*—Wood, Herron & Evans, L.L.P.

[57] ABSTRACT

A manual binder for affixing a slide to the margin of a calendar or the like. The binder crimps a slide located between first and second crimping members upon the margin of a calendar. The slide and calendar are held by the first and second members and a third crimping member forms a bend in the slide. The slide and calendar are repositioned between the first and second members and the bend formed by the third member is crimped closed upon the calendar.

16 Claims, 5 Drawing Sheets

MANUAL CALENDAR BINDER

FIELD OF THE INVENTION

This invention relates to document binders. More specifically, this invention relates to manually binding calendars or the like with a slide.

BACKGROUND OF THE INVENTION

Slides for binding a margin of a calendar, poster and the like are known in the art. A slide is generally an elongated strip of metal typically having a tab attached approximately medially thereto that is folded or crimped one or more times to the margin of, for example, a calendar so that the calendar may be hung by the tab from a desired location, e.g., a wall. Examples of slides are shown in U.S. Pat. Nos. 1,906,024; and 2,042,912.

Attaching a slide to the margin of a calendar or the like, hereinafter referred to as "tinning", is an economical means of production for calendars, especially for companies that use calendars for advertising purposes. Also, it is advantageous to tin other hanging documents, e.g., a poster, with educational material so that it may be easily moved to and from a desired location.

Certain prior art tinners have been fully or semi-automatic so that large numbers of slides per hour may be applied to respective calendars. One such tinner is shown in U.S. Pat. No. 5,707,194, owned by the assignee of the present invention and which is incorporated herein in its entirety by reference. The '194 patent shows a calendar tinner which automatically supplies a metal strip from a roll of metal to a first folding means which automatically folds the metal strip longitudinally. A calendar is then automatically fed into the folded metal strip, whereafter the metal strip is cut to the width of the calendar to form the slide. The slide is then automatically crimped upon the calendar to sandwich the calendar therein. Thereafter, the slide is automatically folded a second time to produce a second bend which is then automatically crimped back upon itself to complete the tinning process.

Other, semi-automatic tinners are available from the assignee of the present invention. The Stuebing Automatic Machine Company provides, for example, an Electric Metal Edger into which a user hand feeds a slide and calendar wherein the edger automatically crimps the slide upon the calendar. Also, a Magnetic Metal Edger automatically feeds the slide and crimps the slide to a calendar inserted therein by a user. These machines can crimp over 600 slides per hour to calendar margins and are generally used by those who wish to tin large volumes of materials. Furthermore, these automatic and semi-automatic machines are intended for large capacity production and are not economical for a small business desiring to produce relatively small volumes of calendars and/or posters for advertising or educational purposes.

On the other hand, known manual tinners are overly complicated and include numerous cams and other operating mechanisms to accomplish the double fold application of the slide to a calendar margin or the like. As such, these known manual tinners are unduly complicated, bulky, oversized and often require excessive maintenance for the function they perform.

OBJECTIVES OF THE INVENTION

It has therefore been an objective of the present invention to provide an improved and relatively inexpensive apparatus for tinning calendars and the like.

It has been a further objective of the present invention to provide an apparatus for tinning calendars and the like that is of simple, reliable construction and does not require excessive maintenance.

It is another object of the present invention to provide an apparatus for tinning calendars and the like which is manually operated and easy to use and maintain.

SUMMARY OF THE INVENTION

These and other objectives of the present invention are achieved with a manual calendar tinner in which a holding bar has registration pins affixed thereto for manually registering a slide thereagainst. The holding bar has an upper surface that is manually pivoted against the lower surface of a clamp bar to crimp the slide therebetween. A forming bar pivotally attached to the leading edge of the holding bar is manually pivoted against the forward surface of the clamp bar while the upper surface of the holding bar is held against the lower surface of the clamp bar so as to form a longitudinal bend in the slide. The lower surface of the clamp bar defines registration holes into which the registration pins are received when the holding bar is pivoted against the clamp bar.

In use, a slide is manually placed against the registration pins and the free edges or margin of a calendar is manually aligned within the slide into registration with the slide's first longitudinal bend. The user manually actuates a bending handle which is attached to a cam shaft having an eccentrically mounted cam attached thereto. The bottom surface of the holding bar rests on the periphery of the cam so that when the user actuates the bending handle, the holding bar is raised up against the clamp bar, thereby, cinching the slide closed upon the calendar. While the holding bar is held against the clamp bar, the user manually actuates the forming bar with a forming handle against the forward surface of the clamp bar, thereby, creating a second longitudinal bend in the slide.

The user then manually releases the slide and calendar from the calendar tinner and repositions the slide and calendar against the registration pins so that the calendar lays substantially flat relative to the holding bar and the forming bar. The user then manually actuates the bending handle which cams the holding bar up against the clamp bar, thereby, cinching closed the second longitudinal bend.

The present inventive calendar tinner has very few moving parts, is compact and lightweight and is simply constructed, thereby, reducing cost and maintenance of the tinner to users who wish to bind relatively small volumes of documents. A user may easily and efficiently manually register a slide against the registration pins; manually crimp it closed upon a calendar; manually form a second bend in the slide; manually reposition the slide in the tinner and, thereafter; manually crimp the slide closed upon the calendar so as to hold the calendar tightly therein.

BRIEF DESCRIPTION OF THE DRAWINGS

The objectives and features of the invention will become more readily apparent from the following detailed description taken in conjunction with the accompanying drawings in which.

DETAILED DESCRIPTION OF THE PREFERRED EMBODIMENT

Figure 1:
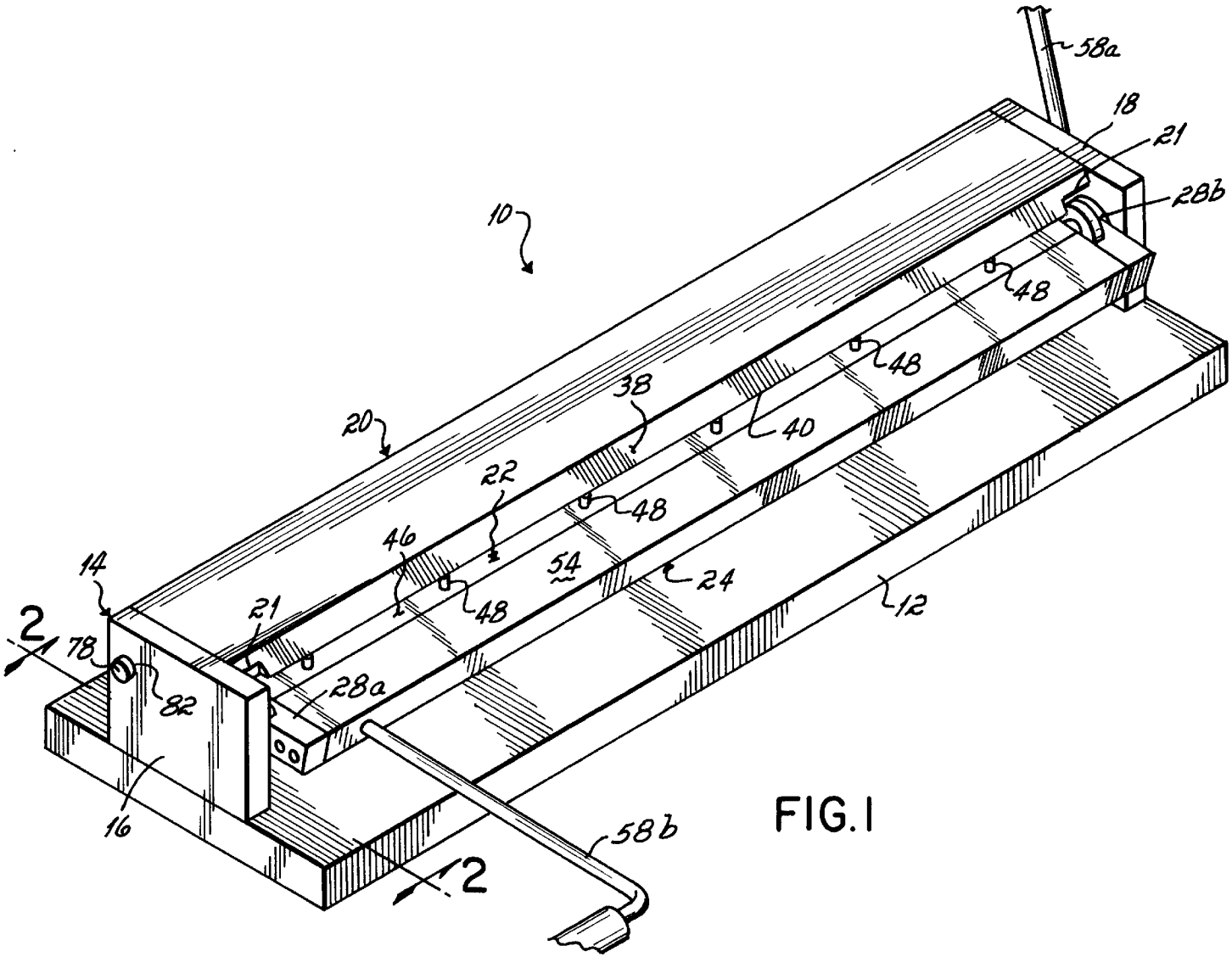
FIG. 1 is a perspective view of a presently preferred embodiment of the present inventive tinner.

A presently preferred embodiment of the present inventive tinner 10 is seen in FIGS. 1–7. It will be understood by those in the art that while the present invention as described is used to bind a calendar 72, the present inventive tinner 10 may be used to bind any other desired document or workpiece.

The tinner 10 has a base 12 that supports a frame 14 having first and second spaced frame ends 16, 18. A crimping member, i.e., clamp bar 20 is fixedly attached to the frame 14 between the frame ends 16, 18 by means known in the art. Beneath the clamp bar 20, another crimping member, i.e., holding bar 22 is pivotally attached to the frame ends 16, 18 near the holding bar's 22 rear edge 44. A third crimping member, i.e., forming bar 24 is pivotally attached proximate the front edge 26 of the holding bar 22 with hinges 28*a*, 28*b*. It will be understood by those in the art that the forming bar 24 may be pivotally attached to the holding bar 22 by any suitable means. The bottom surface 30 of the holding bar 22 rests on the periphery 32 of a cam 34 eccentrically mounted to a cam shaft 36, either end of the cam shaft 36 being received in respective coaxially aligned bores (not shown) in the respective frame ends 16, 18.

Figures 2, 2A:
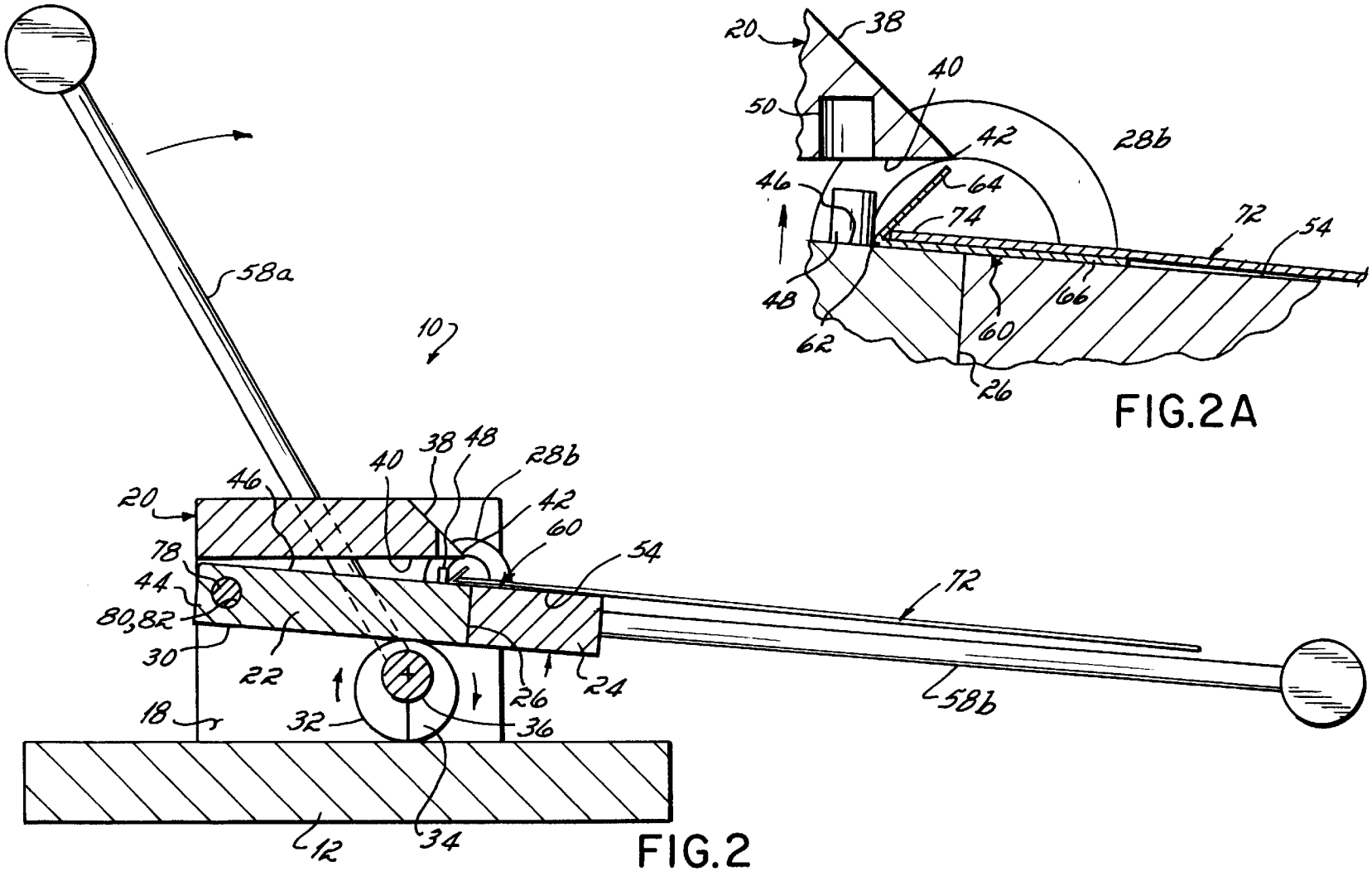
FIG. 2 is a cross-sectional of FIG. 1 taken along line 2—2.
FIG. 2A is close-up view of FIG. 2.

The clamp bar 20 has a forward surface 38 and a lower surface 40 that converge at a bending edge 42 (FIG. 2A). In the preferred embodiment, the forward surface 38 and the lower surface 40 define an angle therebetween less than 90° and most preferably about 45°. It will be understood by those in the art that the forward surface 38 and lower surface 40 may define any angle therebetween sufficient to form a second longitudinal bend 68 (FIG. 5) in a slide 60 when in use, as discussed further below.

The holding bar 22 is pivotally mounted proximate its rear edge 44 to the frame ends 16, 18 which define respective coaxially aligned bores 82 (FIG. 1). In the preferred embodiment, the holding bar 22 defines respective bores 80 (FIG. 2) that are coaxially aligned with the frame end bores 82. Each of the frame bores 82 and holding bar bores 80 receive respective pivot pins 78 therein so that the holding bar 22 may pivot around an axis defined by the frame bores 82 and the holding bar bores 80. It will be understood by those in the art that the holding bar 22 may be pivotally affixed to the frame ends 16, 18 by any suitable means.

The holding bar 22 has an upper surface 46 to which registration pins 48 are mounted proximate the holding bar's front edge 26. When the holding bar 22 is pivoted against the clamp bar lower surface 40, the registration pins 48 are received in registration holes 50 defined in the clamp bar lower surface 40. The registration pins 48 are preferably selectively adjusted between an extended position as shown in the drawings and a retracted position (not shown) in which they are recessed below the plane of the holding bar upper surface 46.

Figure 3A:
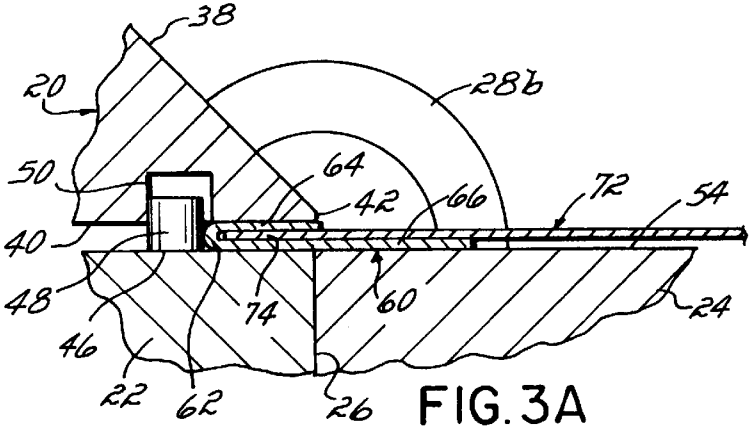
FIG. 3A is an enlarged view of a portion of the embodiment of FIG. 3.
Figure 3B:
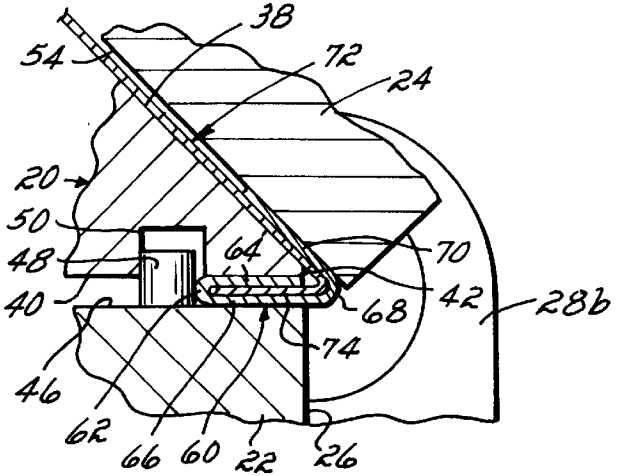
FIG. 3B is a similar view to FIG. 3A showing the present invention binding a calendar slide.
Figure 3:
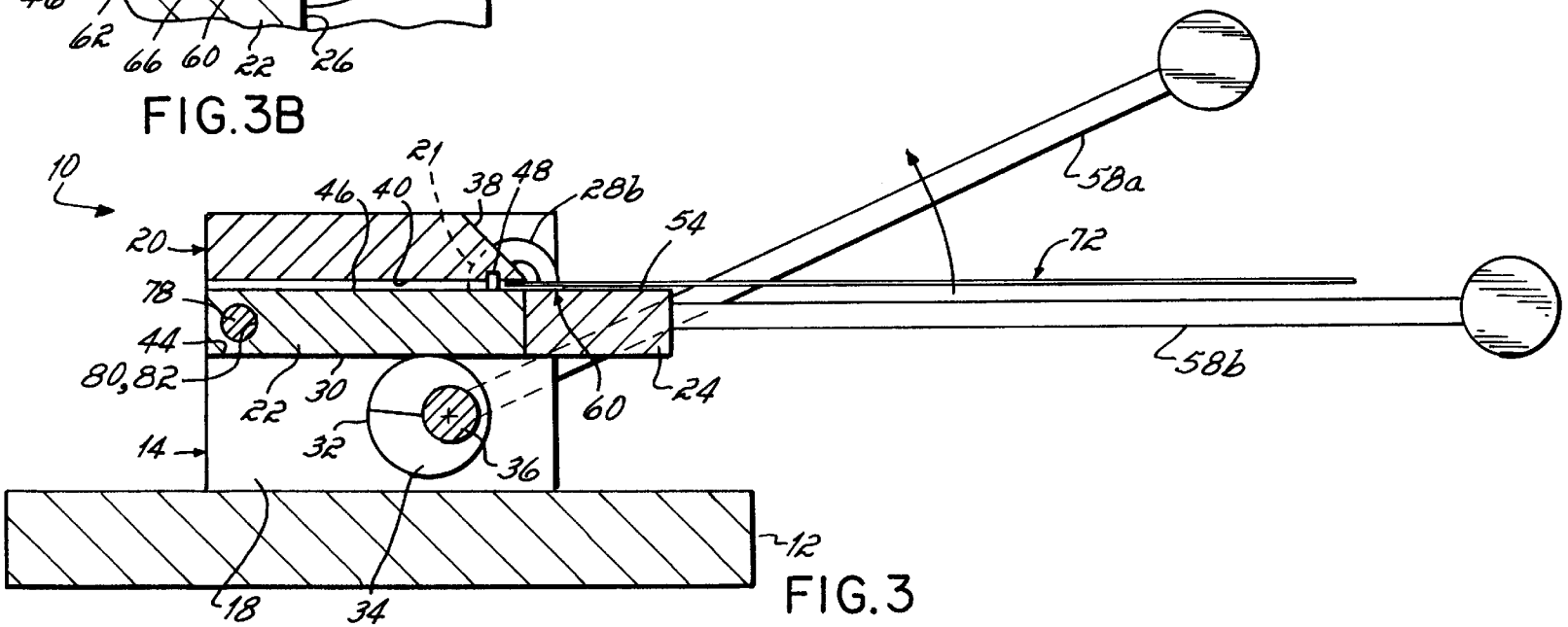
FIG. 3 shows the presently preferred embodiment of the invention binding a calendar.

The forming bar 24 has a forming bar upper surface 54 which is normally substantially coplanar with the holding bar upper surface 46 as shown in FIGS. 1 and 3. The clamp bar 20 defines notches 21 at either end of its longitudinal extent that accommodate the upward movement of the hinges 28*a*, 28*b* therein when the holding bar upper surface 46 is pivoted against clamp bar lower surface 40. When the holding bar upper surface 46 is pivoted against the clamp bar lower surface 40, and the forming bar upper surface 54 is thereafter pivoted against the clamp bar forward surface 38, the notches 21 defined in the clamp bar 20 further accommodate the movement of the hinges 28*a*, 28*b* when the forming bar 24 is moved against the clamp bar 30.

In the preferred embodiment, a first actuator in the form of a bending handle 58*a* is attached to the cam shaft 36 so that the cam shaft 36 with the cams 34 attached thereto may be rotated against the holding bar bottom surface 30, thereby moving the holding bar 22 towards the clamp bar 20.

Also in the preferred embodiment, a second actuator in the form of a forming handle 58*b* is attached to the forming bar 24 so that when the holding bar upper surface 46 is raised against the clamp bar lower surface 40, the forming bar upper surface 54 may be manually pivoted against the clamp bar forward surface 40 via the forming handle 58*b*.

Figure 6:
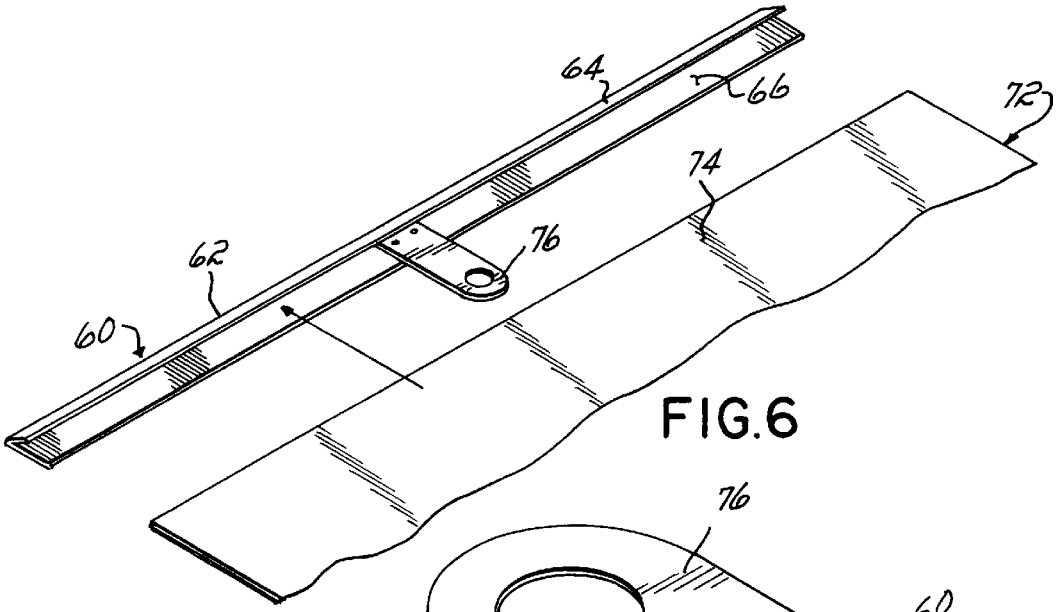
FIG. 6 is a disassembled perspective view of the calendar slide and a calendar.
Figure 7:
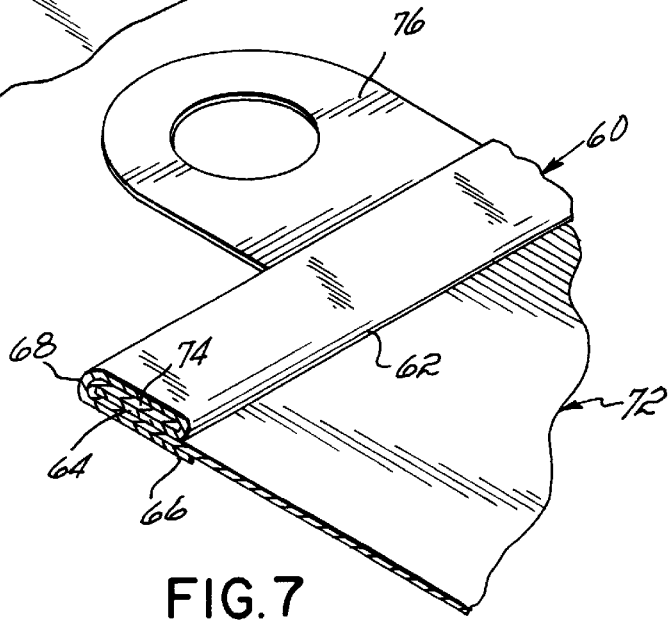
FIG. 7 is a partial perspective view after a calendar has been tinned.

The present inventive tinner 10 allows a user to manually crimp a calendar slide 60 known in the art to the free edge or margin 74 of a calendar 72. Generally, the calendar slide 60 has a first longitudinal bend 62 along its entire longitudinal extent defining a first bend portion 64 and a second bend portion 66. Approximately medially along the calendar slide 60, a hang tab 76 is attached to the second bend portion 66 by means known in the art, as best shown in FIGS. 6 and 7.

In the preferred method of use (FIGS. 2–5), the calendar slide 60 is placed in registration with the extended registration pins 48 so that the first longitudinal bend 62 is registered against the pins 48 and the second bend portion 64 is received against the holding bar upper surface 46 and the forming bar upper surface 54. A user then manually actuates the bending handle 58*a* so that the holding bar upper surface 46 is pivoted substantially against the clamp bar lower surface 40 by rotating the cam shaft 36 so that the eccentrically mounted cam 34 rotates against the holding bar bottom surface 30. As the holding bar 22 is pivoted towards the clamp bar 20, the clamp bar lower surface 40 crimps the first bend portion 64 towards the second bend portion 66. As the user manually exerts further force to bring the holding bar upper surface 46 in substantial engagement with the clamp bar lower surface 40, the first bend portion 64 is crimped down upon the calendar margin 74, trapping the calendar 72 against the second bend portion 66 (FIG. 3 and 3A).

The user then manually pivots the forming bar 24 with the forming handle 58*b* while holding the calendar slide 60 in its fixed location between the holding bar 22 and the clamp bar 20. By pivoting the forming bar 24, the second bend portion 66 of the calendar slide 60 is longitudinally bent approximately in half towards and against the clamp bar forward surface 38, forming a second longitudinal bend 68 in the slide 60, thereby, forming a third bend portion 70.

Figure 3C:
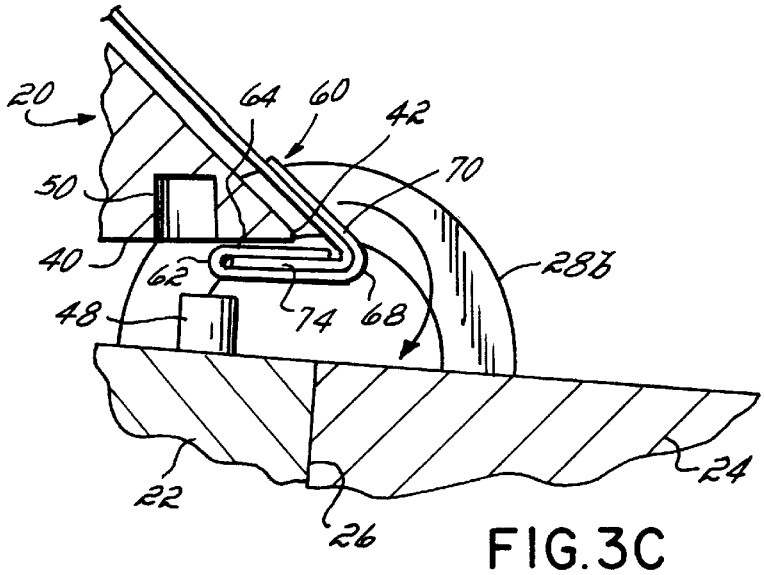

The user then returns the forming handles 58*a* and 58*b* to their respective positions as shown in FIG. 1 and thereby releases the calendar slide 60 from the tinner 10. The user then repositions the calendar slide 60 and calendar 72 so that the second longitudinal bend 68 is registered against the registration pins 48 and so the third bend portion 70 is received against the holding bar upper surface 46 with the calendar 72 laying substantially flat against the forming bar 74, as shown in FIG. 3C.

Figure 4:
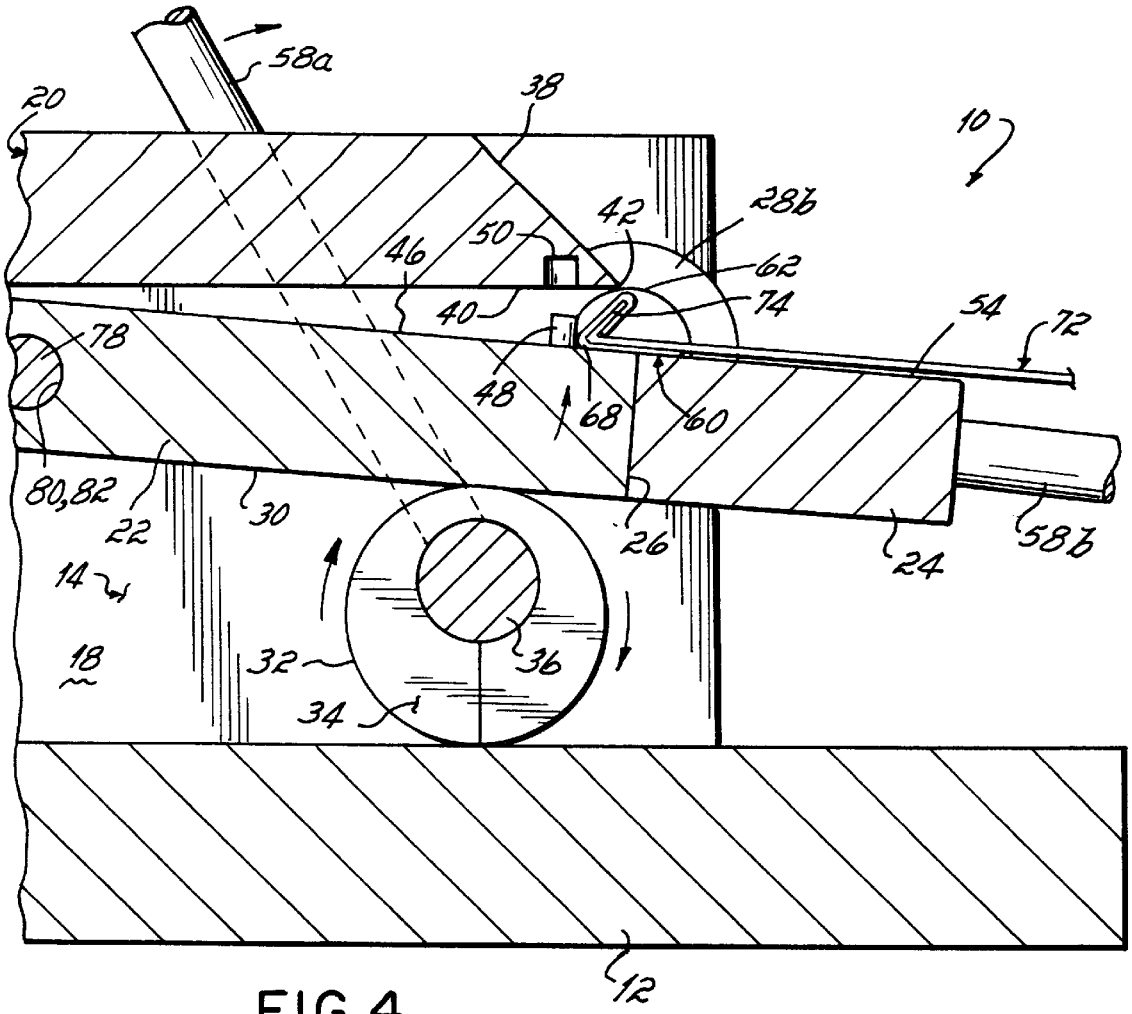
FIG. 4 is an enlarged view of the tinner of to FIG. 2 showing the present invention with the calendar slide repositioned therein.
Figure 5:
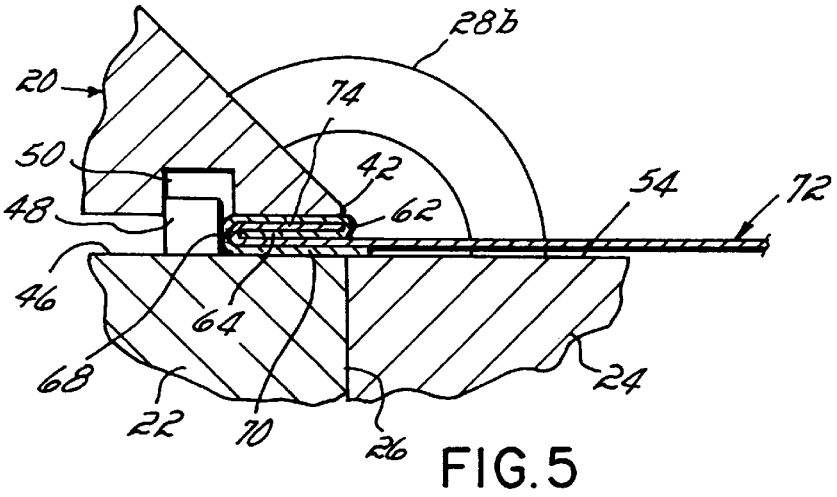
FIG. 5 is an enlarged view of a portion of the tinner of FIG. 4 showing the calendar slide crimped closed upon the calendar.

The user then manually pivots the holding bar 22 with the forming handle 58*a* so that the holding bar upper surface 46 is approximately received against the clamp bar lower surface 40, thereby, crimping the first bend portion 64 closed upon the calendar 72, trapping the calendar 72 against the third bend portion 70, as shown in FIGS. 4 and 5.

From the above disclosure of the detailed description of a presently preferred embodiment of the present invention and the preceding summary of the preferred embodiment, those skilled in the art will comprehend the various modifications to which the present invention is susceptible. Therefore, I desire to be limited only by the scope of the following claims and equivalents thereof.

I claim:

1. A manual tinner for crimping a slide onto a workpiece comprising:

a frame;

a first crimping member mounted to said frame, said first crimping member having a leading edge and a first surface;

a second crimping member mounted to said frame, said second crimping member having a second surface and a third surface converging at a bending edge;

said first and second crimping members being mounted for movement relative to each to crimp the slide and workpiece adapted to be positioned therebetween; and a third crimping member pivotally coupled to said first crimping member proximate said leading edge, said third crimping member having a fourth surface selectively movable to and between a first position substantially coplanar with said first crimping member first surface when said first crimping member and said second crimping member are moved toward each other to crimp the slide and workpiece and a second position in which said third crimping member is juxtaposed against said second crimping member to thereby bend the slide and workpiece around the bending edge.

2. The tinner of claim 1 wherein the first crimping member is pivotally mounted to the frame and the second crimping member is fixedly mounted to the frame.

3. The tinner of claim 2 further comprising:

first and second frame ends;

first and second shaft holes coaxially aligned one with the other in said first and second frame ends, respectively;

a shaft having first and second ends received within said first and second shaft holes, respectively; and a cam eccentrically mounted on said shaft, said first crimping member being received against the perimeter of said cam for movement relative to said second crimping member.

4. The tinner of claim 1 further comprising:

a first actuator connected to said first crimping member for manually moving it toward said second member and thereby crimp the slide and workpiece; and a second actuator connected to said third crimping member for manually pivoting said third crimping member toward said second crimping member and thereby bending the slide and workpiece.

5. The tinner of claim 1 wherein said second crimping member third surface and said second crimping member second surface define an acute angle therebetween at said bending edge.

6. The tinner of claim 1 further comprising:

a plurality of registration members attached to said first crimping member against which the slide is adapted to be positioned.

7. The tinner of claim 6 wherein said third surface defines registration holes for receiving said registration members therein when said first crimping member and said second crimping member are moved toward each other.

8. The tinner of claim 6 wherein the registration members are selectively projected from the first crimping member.

9. A manual calendar tinner for crimping a slide onto a marginal edge of a calendar, the tinner comprising:

a frame;

a first crimping member pivotally attached to said frame, said first crimping member having a leading edge and an upper surface;

a registration member attached to said first crimping member proximate said leading edge against which the slide is adapted to be located;

a second crimping member fixedly attached to said frame, said second crimping member having a forward surface and a lower surface converging at a bending edge, wherein said forward surface and said lower surface define an acute angle therebetween, said lower surface defining a registration hole for receiving said registration member therein when said first crimping member upper surface is manually pivoted toward said lower surface; and a third crimping member pivotally attached to said first crimping member proximate said leading edge, said third crimping member having a top surface selectively pivotal between a first position substantially coplanar with said first crimping member upper surface when said first crimping member upper surface is manually pivoted substantially against said second crimping member lower surface to crimp the slide on the calendar and a second position in which said third crimping member top surface is juxtaposed to said second crimping member forward surface to bend the slide and calendar around the bending edge.

10. A manual calendar tinner for crimping a slide onto a marginal edge of a calendar, the tinner comprising:

a frame having first and second frame ends, wherein said first and second frame ends define first and second shaft holes coaxially aligned one with the other;

a shaft having first and second shaft ends received within said first and second shaft holes, respectively;

a first handle attached to said shaft;

at least one cam eccentrically mounted on said shaft;

a first crimping member pivotally attached to said frame, said first crimping member having a leading edge, an upper surface, a bottom surface and a plurality of registration members attached proximate said leading edge, wherein said bottom surface is received against the periphery of said cam;

a second crimping member fixedly attached to said frame, said second crimping member having a forward surface and a lower surface converging at a bending edge, wherein said forward surface and said lower surface define an acute angle therebetween, said lower surface defining a plurality of registration holes for receiving said registration members therein; and a third crimping member pivotally attached to said first crimping member proximate said leading edge, said third crimping member having a second handle connected thereto and a top surface selectively pivotal between a first position substantially coplanar with said first crimping member upper surface when said first crimping member upper surface is manually pivoted substantially against said second crimping member lower surface to crimp the slide on the calendar and a second position in which said third crimping member top surface is juxtaposed to said second crimping member forward surface to bend the slide and calendar around the bending edge.

11. A method for crimping a slide onto a workpiece comprising the steps of:

positioning the slide relative to a first crimping member, the slide having a longitudinal bend defining first and second bend portions;

placing an edge of the workpiece against the slide longitudinal bend;

manually moving said first crimping member relative to a second crimping member via a first actuator;

crimping the slide between said first and second crimping members so that the workpiece is held between the first and second bend portions;

manually pivoting a third crimping member pivotally attached to said leading edge toward said forward surface so that the slide is bent against said forward surface, wherein the second bend portion is bent longitudinally to form a third bend portion; and releasing the slide from said first, second and third members via the first and second actuators.

12. The method of claim 11 further comprising the steps of:

manually repositioning the slide after the manual pivoting of the third crimping member so that the third bend portion is received against at least one of said first and second crimping members; and manually moving said first crimping member substantially against said second crimping member via the first actuator so that the third bend portion is crimped against the first bend portion.

13. A method for manually tinning a calendar with a slide, comprising the steps of:

manually locating the slide against a plurality of registration members affixed to a first crimping member, the slide having a longitudinal bend defining first and second bend portions;

placing a calendar edge in registration with the slide longitudinal bend;

manually pivoting said first member toward a second crimping member via a first actuator so that said registration members are received in registration holes defined in said second crimping member;

crimping the slide between said first and second members so that the calendar is held between the first and second bend portions;

manually pivoting a third crimping member pivotally attached to said leading edge toward said forward surface via a second actuator so that the slide is bent against said forward surface, wherein the second bend portion is bent longitudinally to form a third bend portion;

releasing the slide from said first, second and third crimping members via said first and second actuators;

manually repositioning the slide against said registration members so that the third bend portion is received against at least one of said first and second crimping members; and manually pivoting said first crimping member toward said second crimping member via the first actuator so that the third bend portion is crimped against the first bend portion.

14. A method for manually tinning a calendar with a slide having a longitudinal bend defining first and second bend portions, comprising the steps of:

manually crimping the first and second bend portions together upon the calendar margin via a first actuator;

holding said slide in a fixed location during said crimping step; and manually bending the second bend portion via a second actuator so as to form a third bend portion while the slide is held in said fixed location.

15. The method of claim 14, further comprising the steps of:

releasing the slide from said fixed location; and manually crimping said third bend portion so that it is received upon the calendar margin proximate said first bend portion.

16. A method for manually tinning a calendar with a slide having a longitudinal bend defining first and second bend portions, comprising the steps of:

manually crimping the first and second bend portions together upon the calendar margin via a first actuator;

holding said slide in a fixed location during said crimping step;

manually bending the second bend portion via a second actuator so as to form a third bend portion while the slide is held in said fixed location; and releasing the slide from said fixed location; and manually crimping said third bend portion via the first actuator so that it is received upon the calendar margin proximate said first bend portion.

* * * * *